US006000953A

United States Patent [19]

Quillet et al.

[11] Patent Number: 6,000,953

[45] Date of Patent: Dec. 14, 1999

[54] INPUT/OUTPUT CONNECTOR FOR PORTABLE DEVICE AND PROCESS FOR MOUNTING SAID CONNECTOR

[75] Inventors: Thierry Quillet, La Milesse; Roger Sureau, Ardenay sur Merize; Christian Tabareau, Le Mans; Olivier Gaumont, Yvre-l'Eveque; Joel Roux, Saint Mars la Briere, all of France

[73] Assignee: Framatome Connectors International, Courbevoie, France

[21] Appl. No.: 09/058,417

[22] Filed: Apr. 9, 1998

[30] Foreign Application Priority Data

Apr. 11, 1997 [FR] France ..... 97 04582

[51] Int. Cl.[6] ..... H01R 9/09; H01R 1/00

[52] U.S. Cl. ..... 439/79; 439/80

[58] Field of Search ..... 439/79, 59, 80, 439/570, 62, 64

[56] References Cited

U.S. PATENT DOCUMENTS

| | | | |
|---|---|---|---|
| 4,647,136 | 3/1987 | Kinoshita et al. | 339/125 R |
| 5,133,670 | 7/1992 | Doi et al. | 439/79 |
| 5,269,694 | 12/1993 | Kachlic et al. | 439/79 |
| 5,451,158 | 9/1995 | Lin et al. | 439/79 |
| 5,504,994 | 4/1996 | Banakis et al. | 29/884 |
| 5,520,545 | 5/1996 | Sipe | 439/65 |
| 5,547,384 | 8/1996 | Benjamin | 439/79 |
| 5,586,008 | 12/1996 | Kozel et al. | 361/743 |
| 5,727,957 | 3/1998 | Hashimoto et al. | 439/79 |
| 5,855,484 | 1/1999 | Hennessey et al. | 439/79 |

FOREIGN PATENT DOCUMENTS

| | | |
|---|---|---|
| 0 633 631 A1 | 1/1995 | European Pat. Off. . |
| WO 96/07221 | 3/1996 | WIPO . |

*Primary Examiner*—Renee S. Luebke
*Assistant Examiner*—Chandrika Prasad
*Attorney, Agent, or Firm*—Perman & Green, LLP

[57] ABSTRACT

An input/output connector (1) intended to be surface mounted on a printed circuit board comprising contacts (3) and two positioning and fixing means (5). The contacts (3) are to be soldered to the printed circuit board. The two positioning and fixing means (5) are also to be soldered to the printed circuit board. Each of the two positioning and fixing means (5) comprise a part (51) intended to come into contact with the printed circuit board. The part (51) intended to come into contact with the printed circuit board of each of the two positioning and fixing means has a projection (52) of small height. The projection (51) determines an axis of rotation XX' of the input/output connector (1) wherein the projection participates in the defining of a reference plane of the said connector (1) on the printed circuit board.

6 Claims, 2 Drawing Sheets

INPUT/OUTPUT CONNECTOR FOR PORTABLE DEVICE AND PROCESS FOR MOUNTING SAID CONNECTOR

The present invention relates to an input/output connector intended to be surface-mounted on a printed circuit board PCB comprising, among other things, contacts to be soldered to the PCB and two positioning and fixing means to be soldered to the PCB. It relates most particularly to the positioning and fixing means as well as to the process for mounting the connector.

In a general and known manner, the input/output connector of a portable communication device, for example a portable communication device such as a mobile telephone, which is of very small dimensions, is surface-mounted on a printed circuit board PCB. For the sake of conciseness and simplification the printed circuit board will hereafter be referred to as PCB ("Printed Circuit Board"), the term commonly used by those skilled in the art. This connector thus makes it possible to connect and disconnect an exterior electronic device, equipped with a complementary connector, to the portable communication device so as to permit dialogue between the two devices, or the testing of the functions or components installed on the PCB. Given the very small size of the connector used for this type of application and the vital need for highly accurate positioning during the mounting thereof, specific means for positioning and fixing must be provided. Thus, when implementing the product, the surface-mounting of the component, and also throughout the lifetime of the portable device, sometimes under severe handling conditions, all the contacts of the complementary connectors should be able to engage with one another and ensure that the contact pressure is adequate for good electrical transmission. Thus, it has been observed that for this function to be effective, it is necessary for the bearing plane of the connector to coincide or at least almost coincide with the plane of the PCB. In fact, this coplanarity provides for an efficient answer to a requirement for so-called coflatness, necessary for the implementation of the surface-mounting process, which requirement implies that any contact must be located within a maximum tolerance interval, which is desired to be small (for example of the order of 0.1 mm), in relation to the plane of bearing of the connector on the PCB, which bearing plane defines the plane of reference for the said coflatness.

International application WO 96/07221 describes positioning and fixing means which consist of metal soldering fixings intended to hold the connector and set it in position on the PCB. However, the use of such fixings has a considerable drawback since it does not allow the abovementioned necessary accuracy and hence the coflatness requirement to be met sufficiently rigorously. This is because the fixings described rest on the PCB over the whole of the surface of their base whilst, moreover, the connector rests at the rear on the said PCB either on a mounting surface or on a set of contacts. Thus, three surfaces which are independent, the two surfaces of the bases of the fixings and the surface via which the rear of the connector rests on the PCB, are in this case involved in determining the plane of bearing of the connector on the PCB. The probability of these three surfaces being coplanar is extremely small. Moreover, the dimensional constraints of the product do not allow sufficiently accurate guiding of the contacts. All of the above implies that this bearing plane evidently cannot be determined in an accurate and reproducible manner and thus that a considerable scatter is created as regards the coflatness.

In this context, the object of the present invention is efficiently to overcome this considerable drawback exhibited by the prior art and proposes an input/output connector whose design makes it possible, during the mounting thereof, to ensure that its plane of bearing on the PCB is determined accurately and reproducibly and thus that the coflatness requirement can thus be satisfied rigorously.

To do this, the input/output connector mentioned in the preamble is noteworthy in that each of the two positioning and fixing means comprises, on the part intended to come into contact with the PCB, a projection of small height determining an axis of rotation of the connector participating in the defining of a reference plane of the said connector on the PCB. The plane of reference thus defined constitutes the plane of bearing of the connector on the PCB.

In a preferred embodiment, the positioning and fixing means are positioning dogs fixed to the lateral parts of the insulating housing of the connector and each of which comprises, on its flat part intended to come into contact with the PCB and located towards its end situated furthest outboard of the PCB, a projection of small height forming a point contact with that part of the PCB intended to receive it, its two points of contact determining an axis of rotation of the connector allowing it, during the mounting thereof, to swing until the surface of the lowermost contact is set in turn almost pointwise into contact with the corresponding contact pad of the PCB, these three points thus defining the plane of bearing of the said connector on the PCB, which bearing plane is the plane of reference for the coflatness of the contacts.

In a likewise noteworthy manner, according to the present invention there is provided a process for mounting the input/output connector, in the course of which the said connector is presented to and jammed into a housing of the PCB provided for this purpose, the two positioning dogs then being placed on the PCB in such a way that the connector swings until the lowermost contact is set in turn almost pointwise into contact with the PCB, the assembly then being pressed together and surface-mounted on the PCB in the exact desired plane.

The following description, in conjunction with the appended drawings, the whole given by way of non-limiting example, will elucidate the manner in which the invention may be practised.

Figure 1:
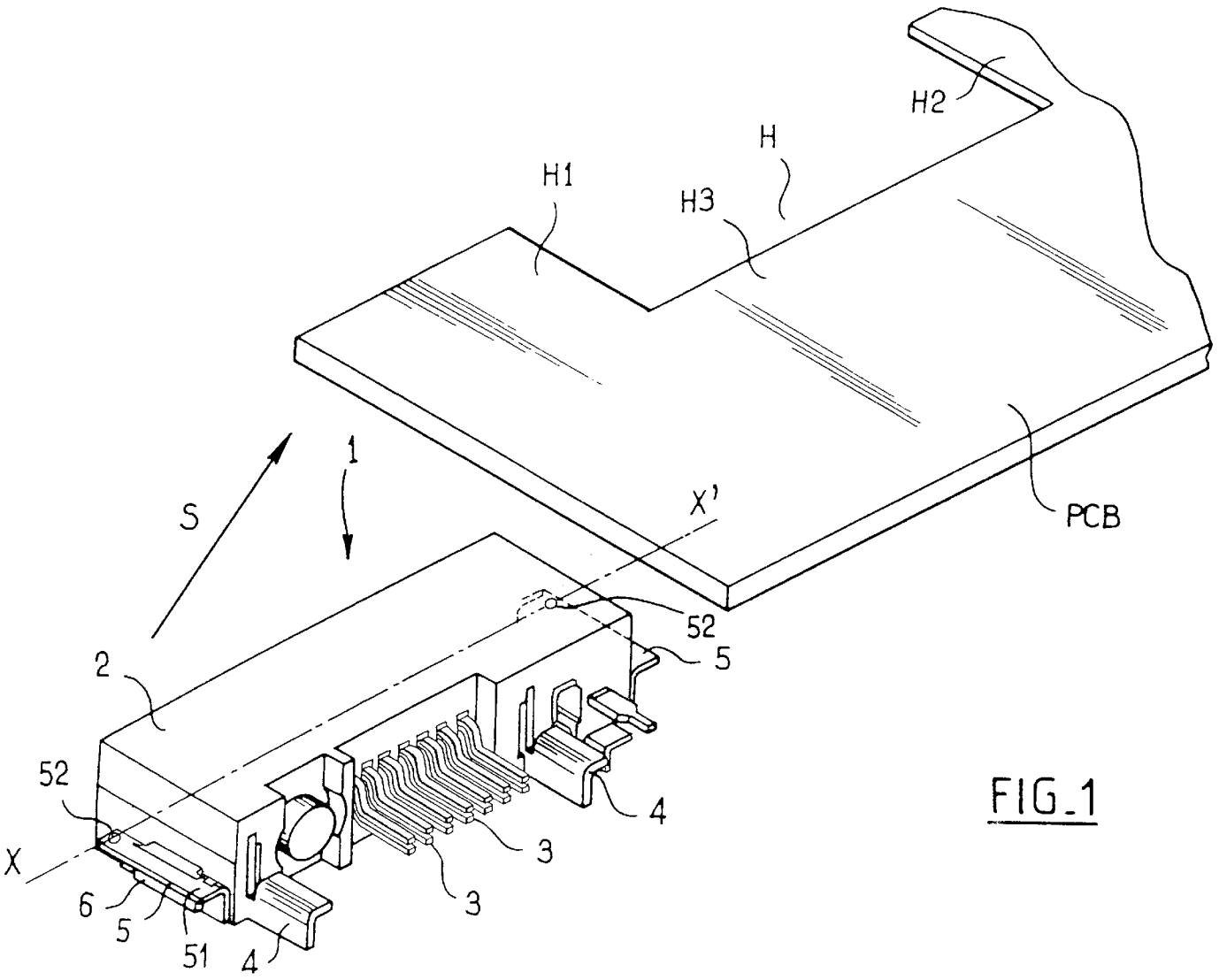
FIG. 1 represents in perspective the connector according to the invention before it is mounted on the PCB.
Figure 2:
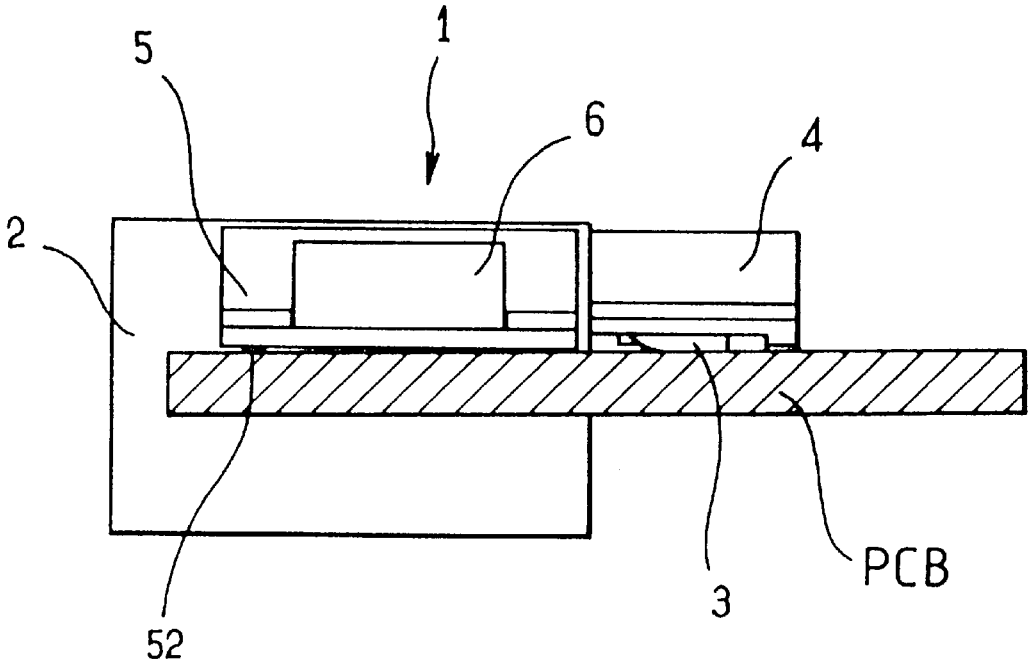
FIG. 2 shows a side view of the connector according to the invention after it is mounted on the PCB.

FIGS. 1 and 2, relating to one embodiment, will be utilized simultaneously for a proper understanding of the characteristics of the connector in accordance with the invention. Represented in perspective in FIG. 1 is a connector 1 intended to be surface-mounted, that is to say to be soldered according to the "surface-mounted components" (termed SMC by those skilled in the art) technology, on a printed circuit board PCB comprising a housing H (FIG. 1) which corresponds to an aperture made in the PCB, to which housing the connector 1 is presented (the arrow labelled S in FIG. 1 specifies the direction of placement), set in position and then jammed fast. The housing H is delimited by two lateral edges H1, H2, defining plane surfaces and a bottom H3 corresponding to the surface of installation of the contacts of the connector.

In FIG. 2, the connector 1 is depicted in a side view after it is mounted on the PCB. The connector 1 consists chiefly of an insulating body 2, it comprises a set of contacts 3, a pair of interlocks 4 intended to be soldered to the PCB as well as a pair of brackets, or positioning dogs 5 likewise intended to be soldered to the surfaces H1 and H2 of the PCB to hold the connector in position on the said PCB. Preferably, the positioning dogs 5 are mounted in a removable manner on the body 2 which, in order to receive them, has on its two side walls two lugs 6 in the shape of an inverted L and under which each positioning dog 5 is slid and immobilized. The position dogs or brackets 5 are captured between the corresponding lugs 6 and the body 2 of the connector 1. In accordance with the invention, in this embodiment described here, each positioning dog 5 comprises, on its flat part 51 intended to come into contact with the surfaces H1 and H2 of the PCB and located towards its end situated furthest outboard of the PCB, a projection 52 of small height designed to form a fulcrum, or point contact with that part H1, H2 of the PCB intended to receive it. Preferably, this projection has the shape of a cone or boss whose vertex is the point of contact with the PCB. The two points of contact of the two projections 52 therefore mathematically determine a straight line support of an axis of rotation XX' of the connector allowing it, during the mounting hereof, to swing (the projections being located towards the ends of the positioning dogs situated furthest outboard of the PCB) until the lowermost contact 3 (the one represented in FIG. 2) is set in turn almost pointwise into contact with the corresponding contact pad of the PCB (not shown in the drawing) situated on the bottom H3. These three points, which are the three lowest bearing points, in turn make it possible mathematically to define the plane of bearing of the connector 1 on the PCB, which bearing plane is the plane of reference for the coflatness of the contacts 3, this bearing plane swinging about the axis XX'.

Thus, to summarize by fixing on the actual principle devised and the process implemented according to the invention, two projections 52 of very small height made on the contact surface 51 of the positioning and fixing means, here the positioning dogs 5, come into contact, during mounting, with the PCB at two points, these two points mathematically determining one straight line and one only, the support of an axis of rotation XX' allowing the connector 1 to swing and to provide a third point of contact when, during the swinging, the first contact 3, that is to say the lowermost contact 3, is applied to the PCB. These three points in turn make it possible mathematically to determine one plane and one only, the plane of bearing of the connector on the PCB. This bearing plane is fully determined and hence efficiently reproducible and since the height of the two projections 52 is an entirely negligible dimension in relation to the distance between the axis of rotation XX' thus determined and the point of contact of the lowermost contact 3, it may be supposed that, in all rigorousness, the plane of bearing of the connector which serves as coflatness reference coincides or almost coincides with the plane of the PCB and thus guarantees that the coflatness requirement is complied with in full. Furthermore, it should be observed that this minuscule inclination, of the connector 1 with respect to the plane of the PCB after swinging, due to the height of the projections 52, has a very advantageous effect since it makes it possible to bring all the contacts 3 close to the plane of the PCB and consequently further to reduce the maximum possible deviation of any contact 3 from the plane of the PCB.

This technique for achieving high accuracy as regards the determination of the bearing plane and excellent reproducibility in relation to the obtaining of the said bearing plane thus advantageously offers an efficient and systematic solution to the problem posed by the coflatness requirement. Once the connector has been set in position accurately and reproducibly the said connector and in particular the set of signal contacts is pressed together and surface-mounted in the exact desired plane. Moreover, it should be noted that the present process in accordance with the invention, as it is described and utilized here, can advantageously be applied to the determination and hence for the obtaining of any desired accurate and reproducible bearing plane.

We claim:

1. An input/output connector for surface mounting on a printed circuit board (PCB), the connector comprising:

a housing with contacts for soldering to the PCB; and positioning and fixing means connected to the housing, the positioning and fixing means comprising a pair of support members adapted to contact the PCB when the connector is mounted to the PCB;

wherein each support member has a projection, the projections on the pair of support members forming a pair of fulcrums of the connector for bearing on the PCB, and for determining a bearing plane of the connector.

2. An input/output connector in accordance with claim 1, wherein the fulcrums on the connector define a reference line (XX') included in the bearing plane of the connector, and wherein when the connector is mounted to the PCB, the connector pivots about the reference line (XX') until a portion of one of the contacts bears against the PCB, the portion of the contact bearing against the PCB and the reference line (XX') formed by the fulcrums defining the bearing plane of the connector which is substantially aligned with the PCB.

3. An input/output connector in accordance with claim 1, wherein the positioning and fixing means comprise a pair of brackets, each bracket being removably connected to lateral sides of the connector housing, and including one support member of the pair of support members, each support member having a substantially flat surface for contacting the PCB when the connector is mounted on the PCB, each projection being disposed on the flat surface of each support member at an end of the support member furthest outboard from the PCB.

4. An input/output connector in accordance with claim 3, wherein the housing has a pair of lugs depending from the lateral sides of the housing, each lug having an inverted L shape, each bracket being slidingly inserted and captured between a corresponding one of the lugs and the lateral side of the housing.

5. An input/output connector in accordance with claim 1, wherein each projection has a general cone shape with a vertex which forms a point of contact with the PCB.

6. A method for mounting an input/output connector to a printed circuit board (PCB), the method comprising the steps of:

providing the connector with a housing having a pair of fulcrums projecting therefrom, the connector having contacts extending from the housing for soldering to the PCB;

positioning the connector on the PCB with the pair of fulcrums bearing on the PCB; and pivoting the connector about a reference line defined by the pair of the fulcrums, the connector being pivoted so that a portion of one of the electrical contacts of the connector contacts the PCB, wherein the reference line defined by the pair of fulcrums and the portion of the contact contacting the PCB define a bearing plane of the connector which is substantially aligned with the PCB.

* * * * *